US007902941B2

(12) United States Patent
Ono et al.

(10) Patent No.: US 7,902,941 B2
(45) Date of Patent: Mar. 8, 2011

(54) LAMINATE TYPE BAND PASS FILTER AND DIPLEXER USING THE SAME

(75) Inventors: Syouji Ono, Ise (JP); Tetsuo Suehiro, Komaki (JP); Jyunichi Ichikawa, Kagamigahara (JP); Keiji Takagi, Iwakura (JP); Manabu Sato, Nagoya (JP)

(73) Assignee: NGK Spark Plug Co., Ltd., Nagoya, Aichi (JP)

( * ) Notice: Subject to any disclaimer, the term of this patent is extended or adjusted under 35 U.S.C. 154(b) by 299 days.

(21) Appl. No.: 12/111,395

(22) Filed: Apr. 29, 2008

(65) Prior Publication Data

US 2008/0272855 A1 Nov. 6, 2008

(30) Foreign Application Priority Data

May 2, 2007 (JP) ..... 2007-121594

(51) Int. Cl.
*H01P 1/203* (2006.01)
*H01P 1/213* (2006.01)

(52) U.S. Cl. ..... 333/134; 333/204; 333/219

(58) Field of Classification Search ..... 333/134, 333/204, 205, 219, 185
See application file for complete search history.

(56) References Cited

U.S. PATENT DOCUMENTS 5,075,650 A * 12/1991 Okamura et al. ..... 333/177
6,127,905 A 10/2000 Horie
6,222,427 B1 4/2001 Kato et al.
6,759,926 B2 7/2004 Yamaguchi
7,116,186 B2 * 10/2006 Chen ..... 333/126
2006/0038638 A1 2/2006 Shinabe

FOREIGN PATENT DOCUMENTS

EP 0 930 701 A 7/1999
EP 1 235 297 A 10/2000

OTHER PUBLICATIONS

European Search Report for European Application No. EP 08 15 5588, Aug. 5, 2009, European Property Office, Munich, Germany.
Ishizaki, Toshi, et al., "A Very Small Dielectric Planar Filter for Portable Telephones," IEEE Transactions on Microwave Theory and Techniques, Nov. 1, 1994, pp. 2017-2022, vol. 42, No. 11, IEEE Service Center, Piscataway, NJ, US.

* cited by examiner

*Primary Examiner* — Robert Pascal
*Assistant Examiner* — Kimberly E Glenn
(74) *Attorney, Agent, or Firm* — Stites & Harbison PLLC; Jeffrey A. Haeberlin

(57) ABSTRACT

It is possible to generate an additionally attenuation pole in a laminate type band pass filter without adding an attenuation circuit and improve the attenuation characteristics of the laminate type band pass filter by independently controlling the frequencies of the attenuation poles. A diplexer is realized by using at least such a filter. The laminate type band pass filter includes a plurality of first resonators adapted to resonate in a predetermined pass band and arranged in a laminate, the first resonators being mutually electromagnetic field coupled, each of the first resonators having a first inductor conductor, a second inductor conductor and a conductor to be capacitive-coupled to a grounding conductor, the second inductor conductor and the conductor to be capacitive-coupled to the grounding conductor forming a second serial resonator in each of the first resonators, the notch frequency of the second serial resonator being set in a frequency band higher than the resonance frequency band of the first resonator.

10 Claims, 12 Drawing Sheets

ELECTRIC CHARACTERISTICS OF A KNOWN BAND PASS FILTER

ELECTRIC CHARACTERISTICS OF THE PRESENT INVENTION

LAMINATE TYPE BAND PASS FILTER AND DIPLEXER USING THE SAME

BACKGROUND OF THE INVENTION

1. Field of the Invention

The present invention relates to a laminate type band pass filter to be used for a microwave band and a diplexer using the same.

2. Description of the Related Art

Structures using via holes as inductor conductors of a resonator have been proposed for filters including a resonator formed by laying a plurality of dielectric layers one on the other have been proposed.

More specifically, Patent Document 1 (Japanese Patent No. 3,127,792) proposes an LC filter including a plurality of dielectric layers that are laid one on the other, a plurality of inductors formed by means of via holes running through the plurality of dielectric layers in the layering direction and a plurality of capacitors, each being formed between capacitor electrodes formed among the plurality of dielectric layers, the inductors being arranged in a direction orthogonal relative to the main surfaces of the capacitor electrodes, the plurality of inductors and the plurality of capacitors being respectively connected in parallel, a plurality of LC resonators being formed by the plurality of inductors and the plurality of capacitors, the plurality of inductors of the plurality of LC resonators being electromagnetically coupled.

Patent Document 2 (Jpn. Pat. Appln. Laid-Open Publication No. 2003-124769) proposes a laminate type LC filter including an input terminal, an output terminal, at least two LC resonators electrically connected to the input terminal and the output terminal, an input side LC trap circuit electrically connected to between the input terminal and the LC resonators and an output side LC trap circuit electrically connected to between the output terminal and the LC resonators, part of the inductor forming the LC resonator electrically connected to the input terminal being commonly used as part of the inductor forming the input side LC trap circuit, part of the inductor forming the LC resonator electrically connected to the output terminal being commonly used as part of the inductor forming the output side LC trap circuit. The Patent Document 2 discloses that the inductors of the LC resonators and the LC trap circuits are formed by means of via holes running through a plurality of dielectric layers in the layering direction.

FIG. 1 of the accompanying drawings is an equivalent electric circuit diagram of a laminate type LC filter 100 disclosed in the Patent Document 2, and FIG. 2 is an exploded schematic perspective view of the laminate type LC filter that is illustrated in FIG. 1.

Referring to FIG. 2, the laminate type LC filter 100 includes an insulator sheet 103 having a coupling capacitor 110 arranged on the surface thereof, an insulator sheet 104 having resonator capacitors 111 and 112 arranged on the surface thereof, insulator sheets 106, 107 respectively having LC trap capacitor conductors 113, 114, 115 and 116 arranged on the surfaces thereof, insulator sheets 105 and 108 respectively having inductor via holes 117*b*, 118*b*, 117*e* and 118*e* and insulator sheets 102, 109 respectively having grounding conductors 119 and 120 on the surfaces thereof.

Inductor via holes 117*a* through 117*e* and inductor via holes 118*a* through 118*e* that operate as resonator coil conductors are successively connected to each other in the layering direction of the insulator sheets 102 through 109 to form resonator inductors L101 and L102 substantially having an effective length of λ/4. The axial direction of the resonator inductors L101 and L102 are perpendicular to the surfaces of the insulator sheets 102 through 109.

On the insulator sheet 104, the drawn out part 111*a* of the resonator capacitor conductor 111 is exposed to the left side and connected to the input terminal while the drawn out part 112*a* of the resonator capacitor conductor 112 is exposed to the right side and connected to the output terminal.

Referring to FIG. 2, the resonator inductor L101 and the resonator capacitor C101 form a parallel resonance circuit and hence an LC resonator Q101. Similarly, the resonator inductor L102 and the resonator capacitor C102 form a parallel resolution circuit and hence an LC resonator Q102. The LC resonators Q101 and Q102 are electrically connected to each other by way of a coupling capacitor C103 to form a two-step band pass filter. The part L101*a* of the resonator inductor L101 and the LC trap capacitor C104 form an input side LC trap circuit T101. Similarly, the part 102*a* of the resonator inductor L102 and the LC trap capacitor C105 form an output side LC trap circuit T102.

SUMMARY OF THE INVENTION

The filters as described in the Patent Documents 1 and 2 have via holes that operate as inductor conductors of resonator. Since the cross sectional area of a via hole is greater than that of a strip line, it is possible to reduce the insertion loss of conductors and improve the insertion loss.

However, with a band pass filter formed by means of two resonators according to the Patent Document 1, it is possible to generate an attenuation pole at the low frequency side of the pass band when the coupling between the resonators is capacitive, while it is possible to generate an attenuation pole at the high frequency side of the pass band when the coupling between the resonators is inductive but one or more attenuation circuits need to be added to generate two or more attenuation poles. Therefore, it is necessary to secure space for the additional circuit or circuits, which can baffle the attempt at downsizing.

The Patent Document 2 proposes addition of one or more new attenuation circuits (trap circuits). According to the Patent Document 2, it is possible to add a trap circuit without increasing the printed conductor layers by using the inductor electrode that forms an LC parallel resonance circuit as part of the inductor electrode for forming a λ/4 resonator and forming the connection electrode for forming the LC parallel resonance circuit in the resonator capacitor forming layer. However, with this arrangement, it is necessary to adjust the "position of electric connection" of the trap circuit electrically connected to the input/output terminal and the resonator in order to adjust the input/output impedance. More specifically, it is necessary to adjust the positions of the drawn out parts 111*a* and 112*a* in the laminating direction in FIG. 13 and they may not necessarily be optimally arranged in the resonator capacitor forming layer. In other words, another layer for printing a connection electrode may need to be added to baffle the attempt at downsizing.

In view of the above-identified circumstances, it is therefore the object of the present invention to provide a laminate type band pass filter in which an additional attenuation pole can be generated without adding an attenuation circuit and whose attenuation characteristics can be improved by independently controlling the frequencies of the attenuation poles and a diplexer using the same.

In an aspect of the present invention, the above object is achieved by providing a laminate type band pass filter comprising a plurality of first resonators adapted to resonate in a predetermined pass band and arranged in a laminate body, the first resonators being mutually electromagnetic field coupled, wherein each of the first resonators includes a first inductor conductor, a second inductor conductor and a conductor to be capacitive-coupled to a grounding conductor, each of the first resonators includes a second resonator therein, each of the second serial resonator including the second inductor conductor and the conductor to be capacitive-coupled to the grounding conductor, and each of the second resonators has a notch frequency set in a frequency band higher than a resonance frequency band of the first resonators.

In one embodiment of the laminate type band pass filter according to the present invention, the laminate body comprises a plurality of dielectric layers having various thicknesses.

Each first resonator may include a capacitor that is connected to the grounding conductor formed on one of the dielectric layers.

The first and second inductor conductors may comprise via conductors provided in the selected ones of the dielectric layers.

The second inductor conductor and the capacitor in the second resonators may be defined so as to resonate at the high frequency side of the resonance frequency of the first resonators.

The resonance frequency of the first resonators may be adjusted by modifying the sizes of the first and second inductor conductors.

The resonance frequency of the first resonators may be adjusted by modifying the thickness of the dielectric layers in which the first and second inductor conductors are formed.

The resonance frequency of the second resonators may be adjusted by modifying the electrostatic capacitances of the capacitors.

The resonance frequency of the second resonators may be adjusted by modifying the sizes of the first and second inductor conductors.

In another aspect of the present invention, there is provided a diplexer including filter having a first pass band and a filter having a second pass band, either or both of the two filters being made of a band pass filter as defined above.

Thus, as defined above, in the laminate type band pass filter according to the present invention, since the second serial resonator that resonates in a frequency band higher than the resonance frequency of the first resolution to generate an attenuation pole is formed by the second inductor conductor and the conductor to be capacitive-coupled to a grounding conductor of each of the first resonators, it is possible to improve the attenuation characteristics at the high frequency side of a desired pass band without using any additional attenuation circuit.

With the above-described arrangement, the resonance frequency of each of the first resonators can be adjusted by modifying the thickness of the laminate and thereby modifying the size of the first inductor and additionally by modifying the magnitude of the capacitive-coupling with the grounding conductor. On the other hand, the resonance frequency of each of the second resonator can be adjusted by modifying the capacitance of the conductor to be capacitive-coupled to the grounding conductor or by modifying the thickness of the laminate and thereby modifying the size of the second inductor.

The influence of the first resonator on the resonance frequency given rise to by modifying the capacitance of the conductor to be capacitive-coupled to the grounding conductor can be offset by modifying the size of the first inductor. Therefore, it is possible to independently adjust the resonance frequency of the first resonator and that of the second resonator. Then, the frequencies can be adjusted with ease to enhance the degree of design freedom.

Additionally, according to the present invention, there is provided a diplexer including filter having a first pass band and a filter having a second pass band, either or both of the two filters being a band pass filter or band pass filters as defined above, whichever appropriate. Such a diplexer shows excellent attenuation characteristics.

DETAILED DESCRIPTION OF THE PREFERRED EMBODIMENTS

Now, the present invention will be described in greater detail by referring to the accompanying drawings that illustrate preferred embodiments of the invention.

Figure 3:
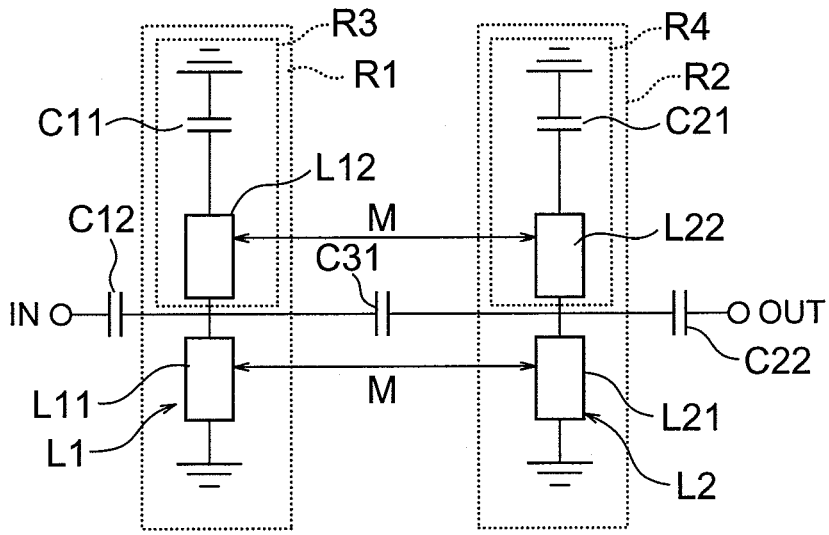
FIG. 3 is a schematic circuit diagram of a band pass filter according to the present invention, showing the circuit configuration thereof.

FIG. 3 is a schematic circuit diagram of an embodiment of band pass filter according to the present invention, showing the circuit configuration thereof.

As shown in FIG. 3, the band pass filter includes two resonant lines.

One of the resonant lines includes a capacitor C11 and resonance elements L11 and L12, whereas the other resonant line includes a capacitor C21 and resonance elements L21 and L22.

The connection point of the resonance elements L11 and L12 of one of the resonant lines is connected to input terminal IN by way of capacitor C12 and also to the connection point of the resonance elements L21 and L22 of the other resonant line by way of capacitor C31. The connection point of the resonance elements L21 and L22 is also connected to output terminal OUT by way of capacitor C22.

Both the resonance element L11 and the capacitor C11 of the former resonant line are grounded. Similarly, both the resonance element L21 and the capacitor C21 of the latter resonant line are grounded.

The reference symbols M in FIG. 3 respectively indicate the inductive coupling between the resonance elements L11 and L21 and the inductive coupling between the resonance elements L12 and L22. The magnitude of each of the inductive couplings can be defined by the gap separating the related resonance elements.

The band pass filter having the above-described configuration has two first resonators R1 and R2 that resonate in a desired pass band and two second serial resonators R3 and R4 that generate an attenuation pole at the high frequency side of the above pass band.

One of the first resonators, or the first resonator R1, that resonates in a desired pass band includes resonance elements L11 and L12 and a capacitor C11, while the other first resonator R2 include resonance elements L21 and L22 and a capacitor C21.

One of the second serial resonators, or the second serial resonator R3, that generates an attenuation pole at the high frequency side of the resonance frequency of the first resonators is formed by the resonance element L12 and the capacitor C11 of the first resonator R1, while the other second serial resonator R4 is formed by the resonance element L22 and the capacitor C21 of the first resonator R2.

With the above-described circuit configuration, the desired pass band for generating resonance is adjusted by means of the elements forming the first resonators R1 and R2 and the attenuation pole at the high frequency side of the pass band of the first resonators is adjusted by means of the elements forming the second resonators R3 and R4.

While the second resonators R3 and R4 that generate an attenuation pole at the high frequency side of a desired pass band for generating resonance are formed by part of the resonance elements, or the resonance elements L12 and L22, and the capacitors C11 and C21 of the first resonators R1 and R2 that resonate in a desired pass band, the influence of adjustment of the frequency of the attenuation poles at the high frequency side is relatively small on the resonance frequency of the first resonators R1 and R2. Additionally, if necessary, it is possible to adjust the frequencies of the attenuation poles by means of the part of the resonance elements, or the resonance elements L11 and L21, of the first resonators R1 and R2. In this way, it is possible to provide the second resonators that generate an attenuation pole at the high frequency sides of the pass bands of the first resonators so as to make them independently adjustable. Therefore, it is possible to improve the attenuation characteristics of the pass bands of the first resonators at the high frequency side without increasing the size of the filter.

Now, specific embodiments of laminate type band pass filter according to the present invention and having the above-described circuit configuration will be described below.

Figure 4:
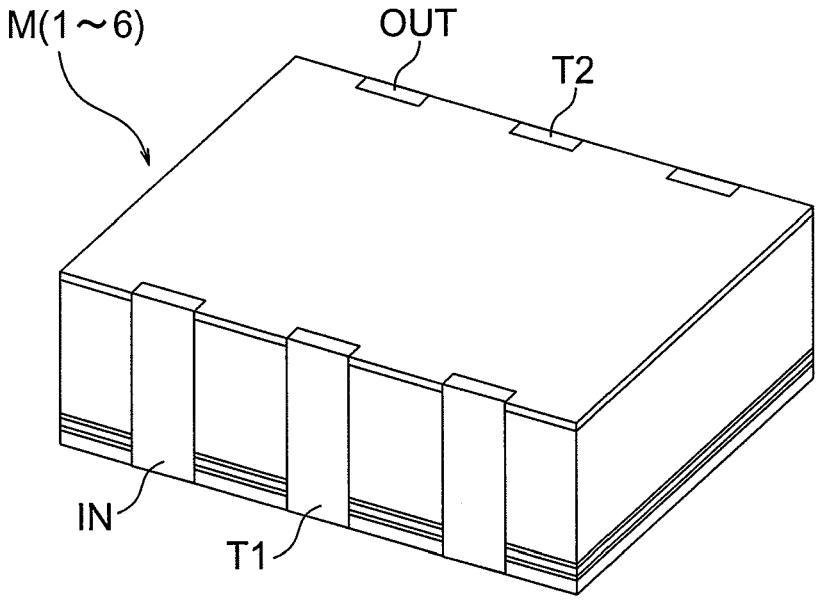
FIG. 4 is a schematic perspective view of an embodiment of laminate type band pass filter having the circuit configuration of FIG. 3, showing the appearance thereof.

FIG. 4 is a schematic perspective view of an embodiment of laminate type band pass filter having the circuit configuration of FIG. 3, showing the appearance thereof.

The band pass filter is formed by a multilayer substrate prepared by laying a total of six dielectric layers M1 through M6 one on the other and has dimensions including a length of about 2.0 mm, a width of about 2.5 mm and a height of about 0.85 mm.

In FIG. 4, the reference symbols T1 and T2 denote respective grounding terminals and the reference symbol IN denotes an input terminal, while the reference symbol OUT denotes an output terminal.

Figure 5:
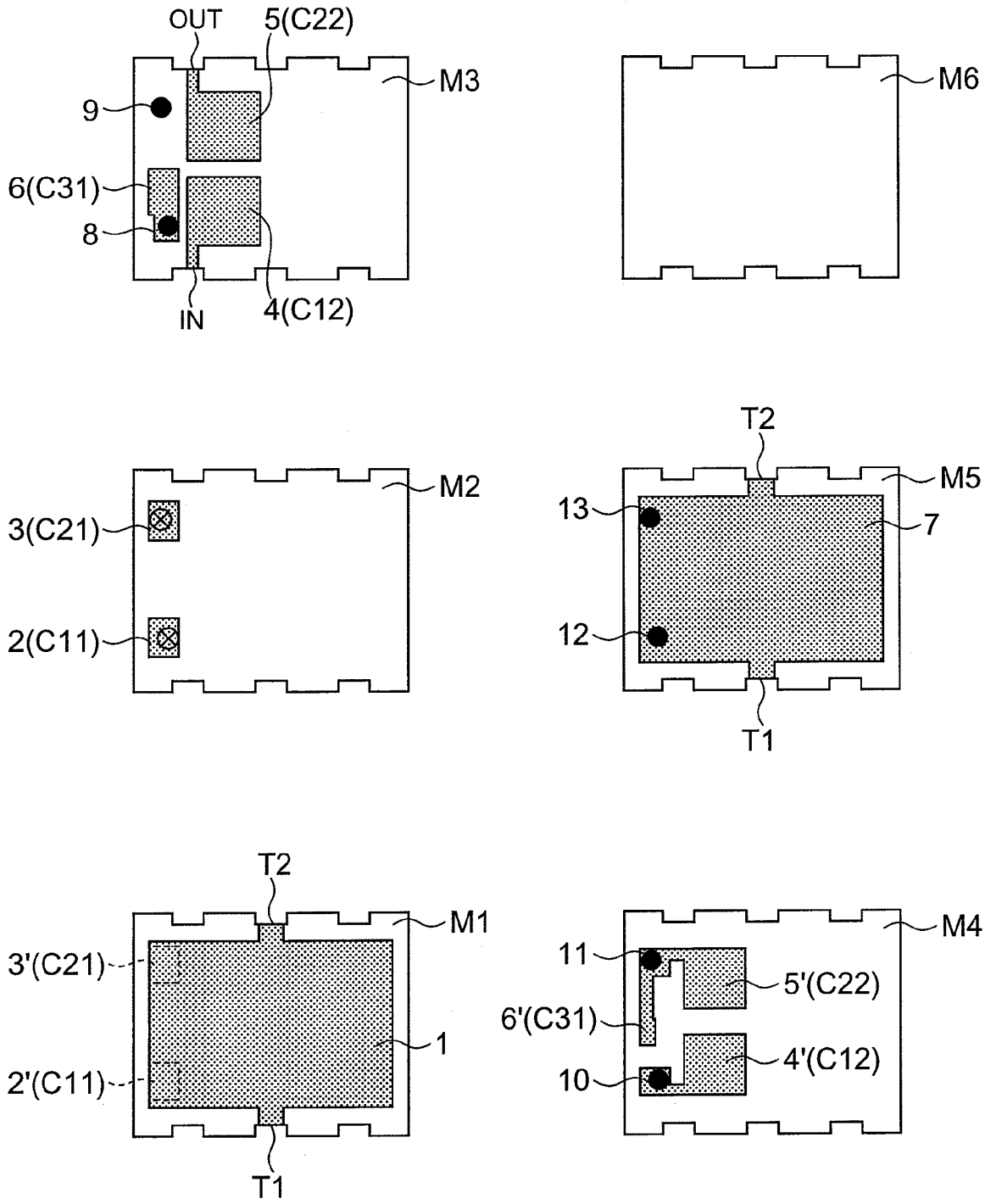
FIG. 5 is schematic plan views of the dielectric layers of the band pass filter of FIG. 4.
Figure 6:
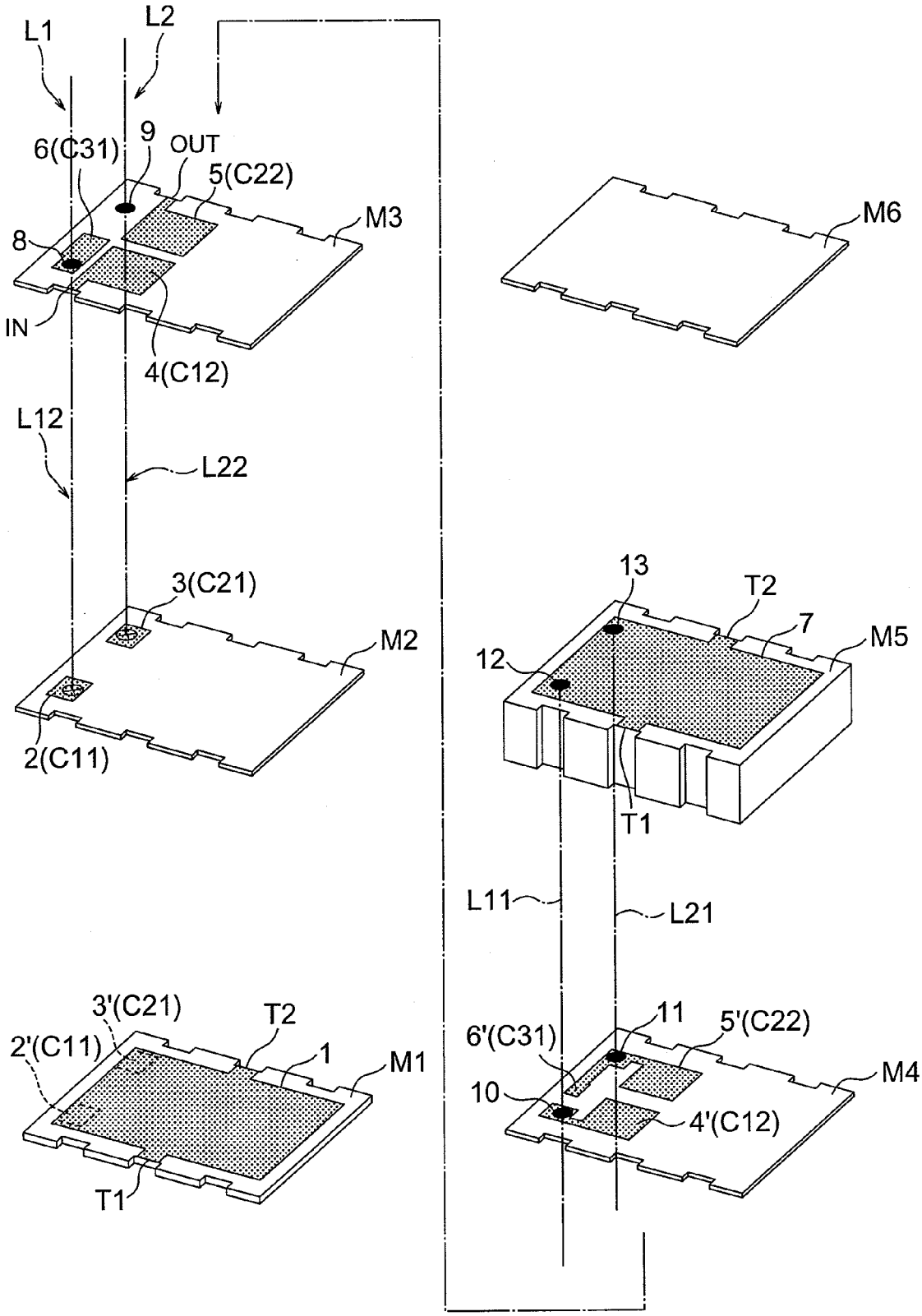
FIG. 6 is an exploded schematic perspective view of the band pass filter of FIG. 4.

FIG. 5 is schematic plan views of the dielectric layers of the band pass filter of FIG. 4 and FIG. 6 is an exploded schematic perspective view of the band pass filter of FIG. 4.

The dielectric layers M1, M3, M5 and M6 are made of a material showing a relatively low dielectric constant (e.g., dielectric constant $\in$ 7), whereas the dielectric layers M2 and M4 are made of a material showing a relatively high dielectric constant (e.g., dielectric constant $\in$ 15).

A pair of oppositely disposed lateral sides of each of the dielectric layers M1 through M6 is provided with three notches at each of the lateral sides. Grounding terminals T1 and T2, an input terminal IN and an output terminal OUT are formed in the notches of each of the dielectric layers. The terminals may alternatively be formed by printing at the lateral sides without forming the notches.

Now, the configuration of each of the dielectric layers M1 through M6 will be described in greater detail below.

A grounding electrode 1 is formed on the lowermost first dielectric layer M1 and connected to grounding terminals T1 and T2.

One of the electrodes, or electrode 2, of the capacitor C11 for forming the resonators R1 and R3 and one of the electrodes, or electrode 3, of the capacitor C21 for forming the resonators R2 and R4 are formed on the second dielectric layer M2.

The other electrode of the capacitor C11 and that of the capacitor C21 are formed respectively at parts 2' and 3' located at corresponding positions of the grounding electrode 1 of the dielectric layer M1.

One of the electrodes, or electrode 4, of the capacitor C12, one of the electrodes, or electrode 5, of the capacitor C22 and one of the electrodes, or electrode 6, of the capacitor C31 are formed on the third dielectric layer M3. The other electrodes 4', 5' and 6' of the capacitors C12, C22 and C31 are formed on the fourth dielectric layer M4.

With the above-described arrangement, the capacitors C12, C22 and C31 are connected in series.

The electrode 4 of the opposite electrodes of the capacitor C12 on the third dielectric layer M3 is connected to the input terminal IN. Similarly, the electrode 5 of the opposite electrodes of the capacitor C22 on the third dielectric layer M3 is connected to the output terminal OUT.

A grounding electrode 7 is formed on the fifth dielectric layer M5 and connected to the grounding terminals T1 and T2.

Via conductors are formed through the dielectric layers M3, M4 and M5 to produce resonance elements. A via conductor refers to a pillar-shaped conductive path made of an conductive material formed in the through holes (via holes) bored through the dielectric layers or arranged along the inner wall of the through holes in order to electrically connect the dielectric layers.

In FIGS. 5 and 6, the reference symbols 8 and 9 denote respective via conductors formed in the dielectric layer M3 and the reference symbols 10 and 11 denote respective via conductors formed in the dielectric layer M4, while reference symbols 12 and 13 denote respective via conductors formed in the dielectric layer M5.

The via conductor 8 formed in the dielectric layer M3 runs through the dielectric layer M3 and its upper end is connected to the electrode 6 of the opposite electrodes of the capacitor C31, while its lower end is connected to the electrode 2 of the opposite electrodes of the capacitor C11.

The via conductor 9 formed in the dielectric layer M3 runs through the dielectric layer M3 and its lower end is connected to the electrode 3 of the opposite electrodes of the capacitor C21.

The via conductor 10 formed in the dielectric layer M4 runs through the dielectric layer M4 and its upper end is connected to the other electrode 4' of the capacitor C12, while its lower end is connected to the via conductor 8 of the dielectric layer M3 by way of the electrode 6 of the opposite electrodes of the capacitor C31.

The via conductor 11 formed in the dielectric layer M4 runs through the dielectric layer M4 and its upper end is connected to the other electrode 5' of the capacitor C22 and the other electrode 6' of the capacitor C31, while its lower end is connected to the via conductor 9 of the dielectric layer M3.

The via conductor 12 formed in the dielectric layer M5 runs through the dielectric layer M5 and its upper end is connected to the grounding electrode 7, while its lower end is connected to the via conductor 10 of the dielectric layer M4 by way of the other electrode 4' of the capacitor C12.

The via conductor 13 formed in the dielectric layer M5 runs through the dielectric layer M5 and its upper end is connected to the grounding electrode 7, while its lower end is connected to the via conductor 11 of the dielectric layer M4 by way of the other electrode 5' of the capacitor C22 and the other electrode 6' of the capacitor C31.

With the above-described arrangement, the single resonance element L1 is formed by the via conductors 8, 10 and 12 and the electrode 2 of the opposite electrodes of the capacitor C11, whereas the single resonance element L2 is formed by the via conductors 9, 11 and 13 and the electrode 3 of the opposite electrodes of the capacitor C21.

The axial direction of the two resonance elements L1 and L2 is perpendicular to the surfaces of the dielectric layers M1 through M6 and hence, as an electric current flows through the resonance elements L1 and L2, a magnetic field that runs round on a plane perpendicular to the axial direction of the resonance elements L1 and L2 is generated around each of the resonance elements L1 and L2.

One of the resonance elements, or the resonance element L1 that is formed by the via conductors 8 and 10 and the electrode 2 of the opposite electrodes of the capacitor C11, has a structure where an intermediate tap is formed between the part of the resonance element L12 formed by the via conductors 8 and 10 and the part of the resonance element L11 formed by the via conductor 12 due to the electrodes 4, 4' and 6 of the capacitors C12 and C31.

On the other hand, the other resonance element L2 formed by the via conductors 9, 11 and 13 and the electrode 3 of the opposite electrodes of the capacitor C21 has a structure where an intermediate tap is formed between the part of the resonance element L22 formed by the via conductors 9 and 11 and the part of the resonance element L21 formed by the via conductor 13 due to the electrodes 5, 5' and 6' of the capacitors C22 and C31.

With the above-described arrangement of the laminate type band pass filter, the resonance frequency of the first and second resonators R1 and R2 can be adjusted by modifying the sizes of the inductors formed by the via holes 8 through 13 bored through the dielectric layers M3, M4 and M5. More specifically, the sizes of the inductors can be adjusted by modifying the thickness of the laminate type band pass filter. The resonance frequency can be adjusted by modifying the electrostatic capacitances of the capacitors C11 and C21. More specifically, the electrostatic capacitances of the capacitors C11 and C21 can be adjusted by modifying the sizes of the electrodes 2 and 3 of the dielectric layer M2 or by modifying the thickness of the dielectric layer M2.

On the other hand, each of the elements of the second resonators R3 and R4 is defined so as to resonate at the high frequency side of the resonance frequency of the first resonators R1 and R2 and the resonance frequency can be adjusted by modifying the electrostatic capacitances of the capacitors C11 and C21. More specifically, the electrostatic capacitances of the capacitors C11 and C21 can be adjusted by modifying the sizes of the electrodes 2 and 3 of the dielectric layer M2 or by modifying the thickness of the dielectric layer M2. Additionally, they can also be adjusted by modifying the sizes of the inductors formed by the via holes 8 through 11 bored through the dielectric layers M3 and M5. More specifically, the sizes of the inductors can be adjusted by modifying the thicknesses of the dielectric layers M3 and M4.

Since the influence of adjusting the sizes of the electrodes 2 and 3 of the dielectric layer M2 and modifying the thicknesses of the dielectric layers M3 and M4 on the resonance frequency of the first resonators R1 and R2 is smaller than the influence on the resonance frequency of the second resonators R3 and R4, the influence of adjusting the resonance frequency of the second resonators R3 and R4 on the resonance frequency of the first resonators R1 and R2 is small and insignificant. Additionally, since the resonance frequency of the first resonators R1 and R2 can be adjusted, if necessary, by modifying the thickness of the dielectric layer M5, it is possible to adjust the resonance frequency of the first resonators R1 and R2 and that of the second resonators R3 and R4 independently.

In the embodiment of FIGS. 4 through 6, the dielectric layers M1, M2, M3, M4, M5 and M6 respectively have thicknesses of 0.06 mm, 0.019 mm, 0.03 mm, 0.019 mm, 0.549 mm and 0.03 mm.

Figure 7A:
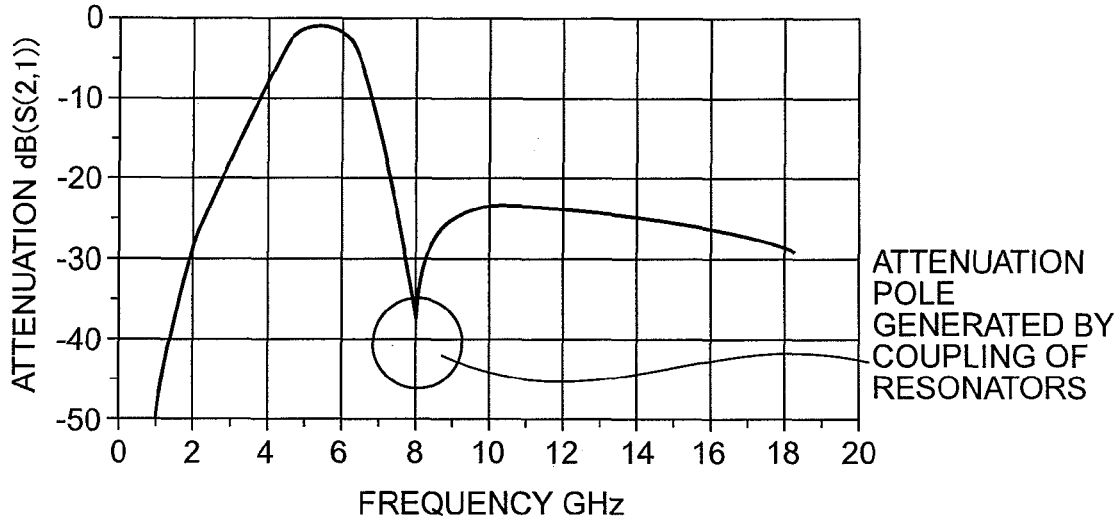
FIG. 7A PRIOR ART
FIG. 7A is a graph illustrating the electric characteristics of a known laminate type band pass filter not having any serial resonators for generating an attenuation pole.
Figure 7B:
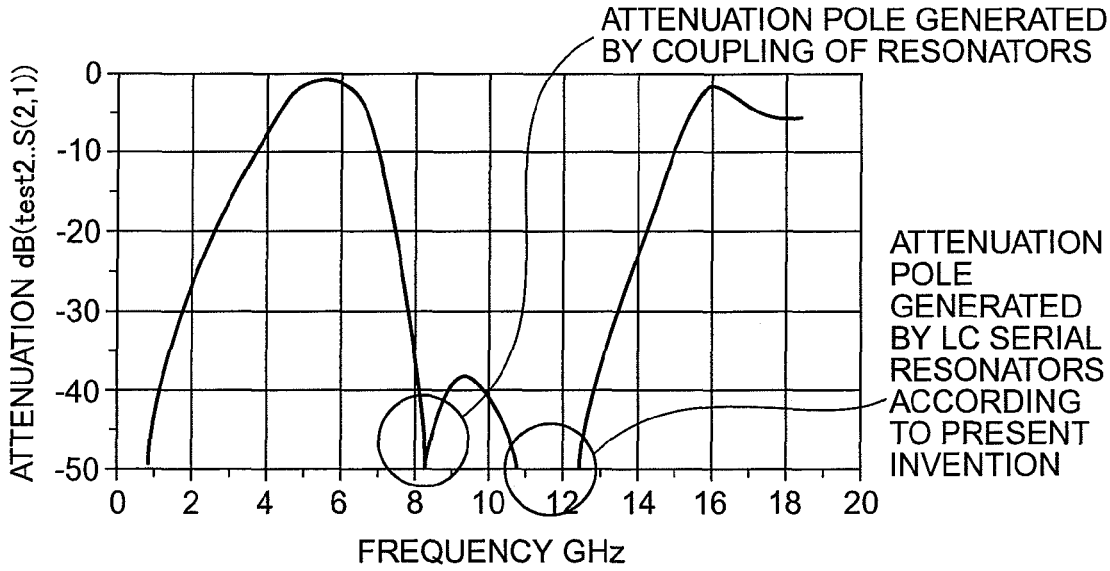
FIG. 7B is a graph illustrating the electric characteristics of a laminate type band pass filter according to the present invention and illustrated in FIGS. 4 through 6.

FIG. 7A is a graph illustrating the electric characteristics of a known laminate type band pass filter not having any serial resonators for generating an attenuation pole and FIG. 7B is a graph illustrating the characteristics of a laminate type band pass filter according to the present invention and illustrated in FIGS. 4 through 6.

As shown in FIG. 7A, an attenuation pole is generated only in the frequency band of 8 GHz of the known band pass filter.

On the other hand, in the laminate type band pass filter according to the present invention, an attenuation pole is generated in the frequency band of 8 GHz due to the coupling of the first resonators R1 and R2 and another attenuation pole is generated in the frequency band of 12 GHz that is located at the higher frequency side of the former frequency band due to the second resonators R3 and R4 as seen from FIG. 7B.

Now, the second embodiment of laminate type band pass filter having a circuit configuration as shown in FIG. 3 will be described below by referring to FIGS. 8 and 9.

Figure 8:
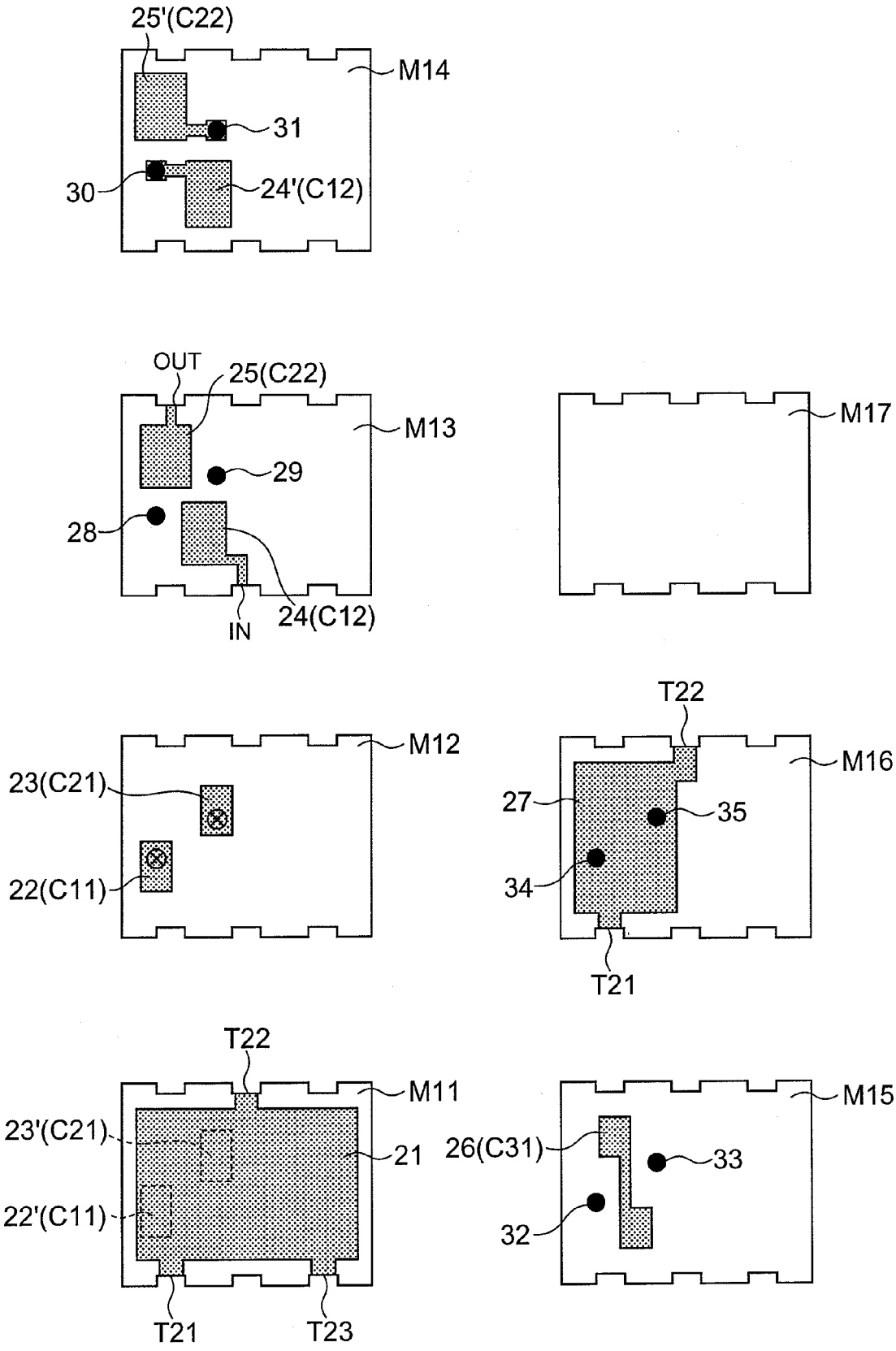
FIG. 8 is schematic plan views of the dielectric layers of the second embodiment of laminate type band pass filter having the circuit configuration of FIG. 3.

FIG. 8 is schematic plan views of the dielectric layers of the second embodiment of laminate type band pass filter having the circuit configuration of FIG. 3. FIG. 9 is an exploded schematic perspective view of the band pass filter of FIG. 8.

The band pass filter includes a total of seven dielectric layers M11 through M17.

The dielectric layers M11, M13, M16 and M17 are made of a material showing a relatively low dielectric constant (e.g., dielectric constant ∈ 7), whereas the dielectric layers M12, M14 and M15 are made of a material showing a relatively high dielectric constant (e.g., dielectric constant ∈ 15).

The dielectric layers M11, M12, M13, M14, M15, M16 and M17 respectively have thicknesses of 0.06 mm, 0.019 mm, 0.03 mm, 0.019 mm, 0.019 mm, 0.50 mm and 0.03 mm.

A pair of oppositely disposed lateral sides of each of the dielectric layers M11 through M17 is provided with three notches at each of the lateral sides. Grounding terminals T21, T22 and T23, an input terminal IN and an output terminal OUT are formed in the notches of each of the dielectric layers. Note that the terminals may alternatively be formed by printing at the lateral sides without forming the notches.

Now, the configuration of each of the dielectric layers M11 through M17 will be described in greater detail below.

A grounding electrode 21 is formed on the lowermost first dielectric layer M11 and connected to grounding terminals T21, T22 and T23.

One of the electrodes, or electrode 22, of the capacitor C11 for forming the resonators R1 and R3 and one of the electrodes, or electrode 23, of the capacitor C21 for forming the resonators R2 and R4 are formed on the second dielectric layer M12.

The other electrode of the capacitor C11 and that of the capacitor C21 are formed respectively at parts 22' and 23' located at corresponding positions of the grounding electrode 21 of the dielectric layer M11.

One of the electrodes, or electrode 24, of the capacitor C12 and one of the electrodes, or electrode 25, of the capacitor C22 are formed on the third dielectric layer M13. The other electrodes 24' and 25' of the capacitors C12 and C22 are formed on the fourth dielectric layer M14.

The electrode 24 of the opposite electrodes of the capacitor C12 on the third dielectric layer M13 is connected to the input terminal IN. Similarly, the electrode 25 of the opposite electrodes of the capacitor C22 on the third dielectric layer M13 is connected to the output terminal OUT.

One of the electrodes, or electrode 26, of the capacitor C31 is formed on the fifth dielectric layer M15 and a grounding electrode 27 is formed on the sixth dielectric layer M16 and connected to the grounding terminals T21 and T22.

The other electrode of the capacitor C31 is formed by the other electrodes 24' and 25' of the capacitors C12 and C22 formed on the dielectric layer M14. With the above-described arrangement, the capacitors C12, C22 and C31 are connected in series.

Via conductors are formed through the dielectric layers M13, M14, M15 and M16 to produce resonance elements.

Figure 9:
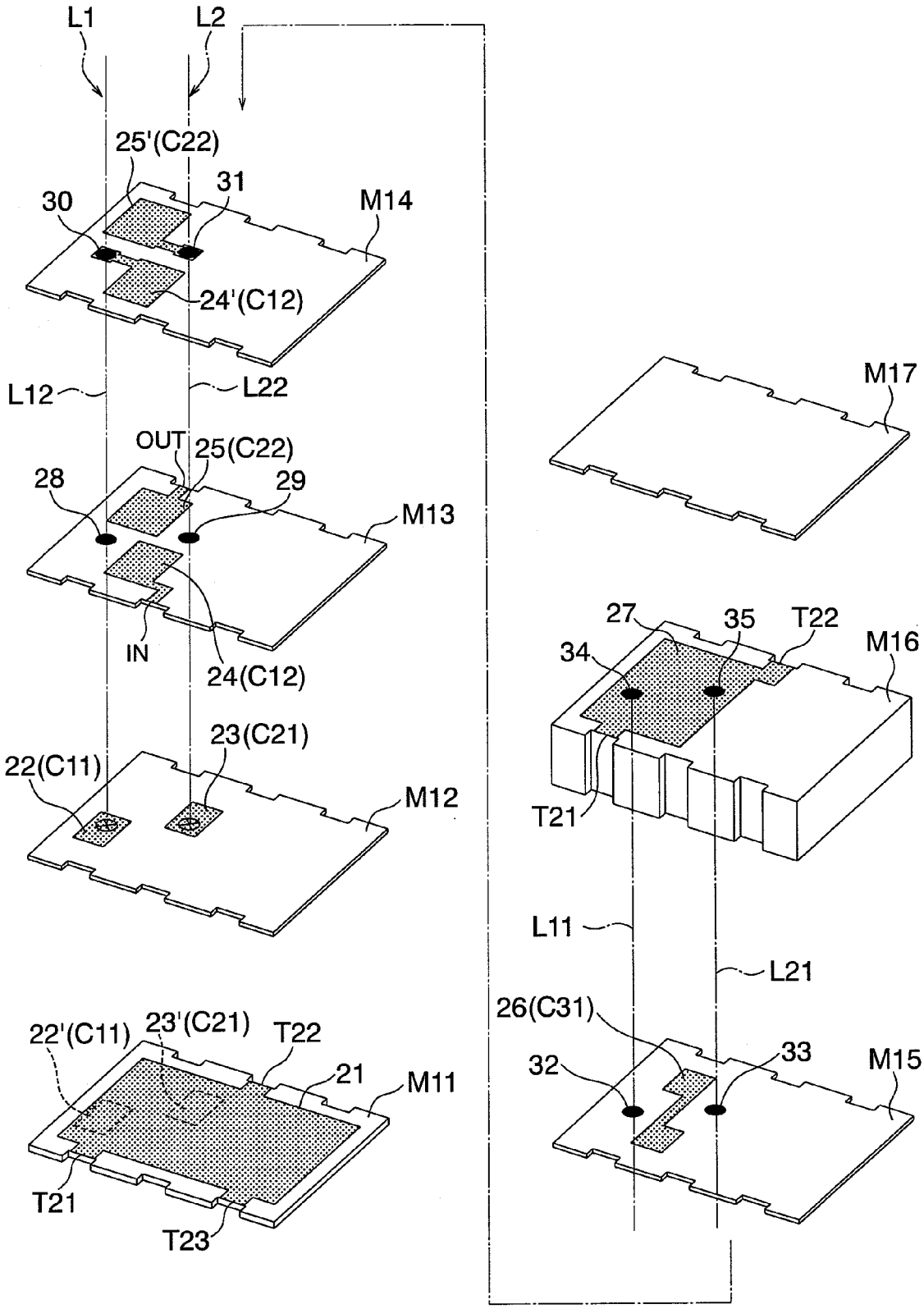
FIG. 9 is an exploded schematic perspective view of the band pass filter of FIG. 8.

In FIGS. 8 and 9, the reference symbols 28 and 29 denote respective via conductors formed in the dielectric layer M13 and the reference symbols 30 and 31 denote respective via conductors formed in the dielectric layer M14, while reference symbols 32 and 33 denote respective via conductors formed in the dielectric layer M15 and reference symbols 34 and 35 denote respective via conductors formed in the dielectric layer M16.

The via conductor 28 formed in the dielectric layer M13 runs through the dielectric layer M13 and its lower end is connected to the electrode 22 of the opposite electrodes of the capacitor C11.

The via conductor 29 formed in the dielectric layer M13 runs through the dielectric layer M13 and its lower end is connected to the electrode 23 of the opposite electrodes of the capacitor C21.

The via conductor 30 formed in the dielectric layer M14 runs through the dielectric layer M14 and its upper end is connected to the other electrode 24' of the capacitor C12, while its lower end is connected to the via conductor 28 of the dielectric layer M13.

The via conductor 31 formed in the dielectric layer M14 runs through the dielectric layer M14 and its upper end is connected to the other electrode 25' of the capacitor C22, while its lower end is connected to the via conductor 29 of the dielectric layer M13.

The via conductor 32 formed in the dielectric layer M15 runs through the dielectric layer M15 and its lower end is connected to the via conductor 30 of the dielectric layer M14 by way of the other electrode 24' of the capacitor C12.

The via conductor 33 formed in the dielectric layer M15 runs through the dielectric layer M15 and its lower end is connected to the via conductor 31 of the dielectric layer M14 by way of the other electrode 25' of the capacitor C22.

The via conductor 34 formed in the dielectric layer M16 runs through the dielectric layer M16 and its upper end is connected to the grounding electrode 27, while its lower end is connected to the via conductor 32 of the dielectric layer M15.

The via conductor 35 formed in the dielectric layer M16 runs through the dielectric layer M16 and its upper end is connected to the grounding electrode 27, while its lower end is connected to the via conductor 33 of the dielectric layer M15.

With the above-described arrangement, the single resonance element L1 is formed by the via conductors 28, 30, 32 and 34 and the electrode 22 of the opposite electrodes of the capacitor C11, whereas the single resonance element L2 is formed by the via conductors 29, 31, 33 and 35 and the electrode 23 of the opposite electrodes of the capacitor C21.

The axial direction of the two resonance elements L1 and L2 is perpendicular to the surfaces of the dielectric layers M11 through M17 and hence, as an electric current flows through the resonance elements L1 and L2, a magnetic field that runs round on a plane perpendicular to the axial direction of the resonance elements L1 and L2 is generated around each of the resonance elements L1 and L2.

One of the resonance elements, or the resonance element L1 that is formed by the via conductors 28, 30, 32 and 34 and the electrode 22 of the opposite electrodes of the capacitor C11, has a structure where an intermediate tap is formed between the part of the resonance element L12 formed by the via conductors 28 and 30 and the part of the resonance element L11 formed by the via conductors 32 and 34 due to the electrodes 24, 24' and 26 of the capacitors C12 and C31.

On the other hand, the other resonance element L2 formed by the via conductors 29, 31, 33 and 35 and the electrode 23 of the opposite electrodes of the capacitor C21 has a structure where an intermediate tap is formed between the part of the resonance element L22 formed by the via conductors 29 and 31 and the part of the resonance element L21 formed by the via conductors 33 and 35 due to the electrodes 25, 25' and 26 of the capacitors C22 and C31.

With the above-described arrangement of the laminate type band pass filter, the resonance frequency of the first and second resonators R1 and R2 can be adjusted by modifying the sizes of the inductors formed by the via holes 28 through 35 bored through the dielectric layers M13, M14, M15 and M16. More specifically, the sizes of the inductors can be adjusted by modifying the thickness of the laminate type band pass filter. The resonance frequency can be adjusted by modifying the electrostatic capacitances of the capacitors C11 and C21. More specifically, the electrostatic capacitances of the capacitors C11 and C21 can be adjusted by modifying the sizes of the electrodes 22 and 23 of the dielectric layer M12 or by modifying the thickness of the dielectric layer M12.

On the other hand, each of the elements of the second resonators R3 and R4 is defined so as to resonate at the high frequency side of the resonance frequency of the first resonators R1 and R2 and the resonance frequency can be adjusted by modifying the electrostatic capacitances of the capacitors C11 and C21. More specifically, the electrostatic capacitances of the capacitors C11 and C21 can be adjusted by modifying the sizes of the electrodes 22 and 23 of the dielectric layer M12 or by modifying the thickness of the dielectric layer M12. Additionally, they can also be adjusted by modifying the sizes of the inductors formed by the via holes 28 through 31 bored through the dielectric layers M13 and M14. More specifically, the sizes of the inductors can be adjusted by modifying the thicknesses of the dielectric layers M13 and M14.

Since the influence of adjusting the sizes of the electrodes 22 and 23 of the dielectric layer M2 and modifying the thicknesses of the dielectric layers M13 and M14 on the resonance frequency of the first resonators R1 and R2 is smaller than the influence on the resonance frequency of the second resonators R3 and R4, the influence of adjusting the resonance frequency of the second resonators R3 and R4 on the resonance frequency of the first resonators R1 and R2 is small and insignificant. Additionally, since the resonance frequency of the first resonators R1 and R2 can be adjusted, if necessary, by modifying the thickness of the dielectric layers M15 and M16, it is possible to adjust the resonance frequency of the first resonators R1 and R2 and that of the second resonators R3 and R4 independently.

Figure 1:
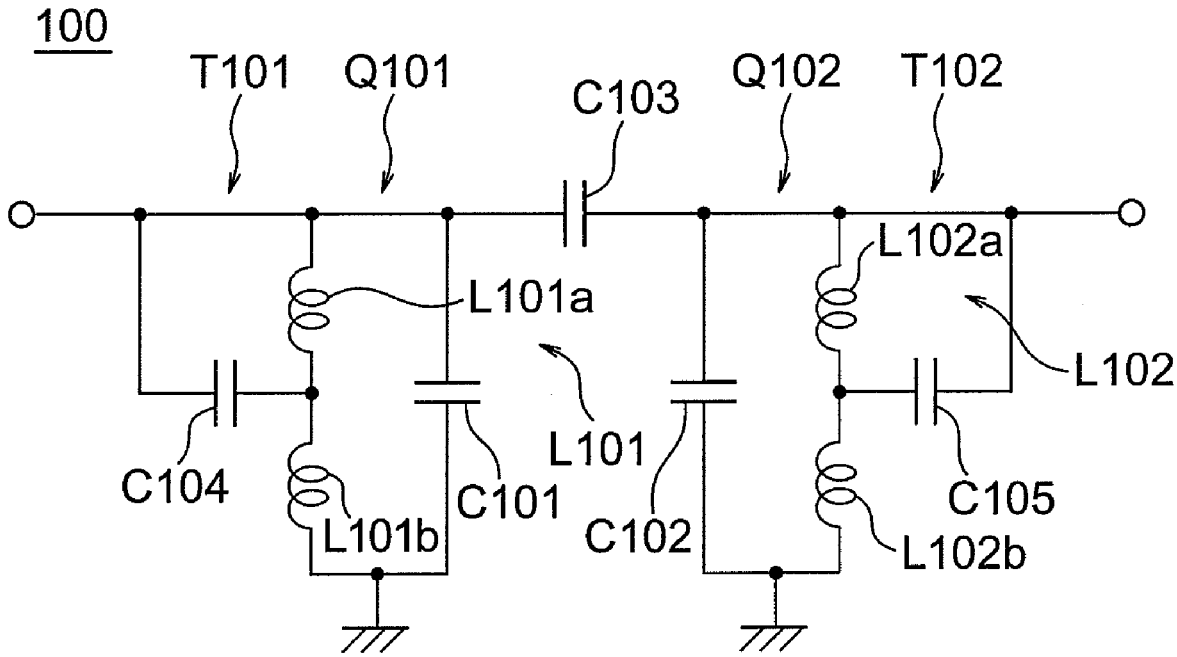
FIG. 1 PRIOR ART
FIG. 1 is an electric equivalent circuit diagram of a known laminate type LC filter 100.
Figure 2:
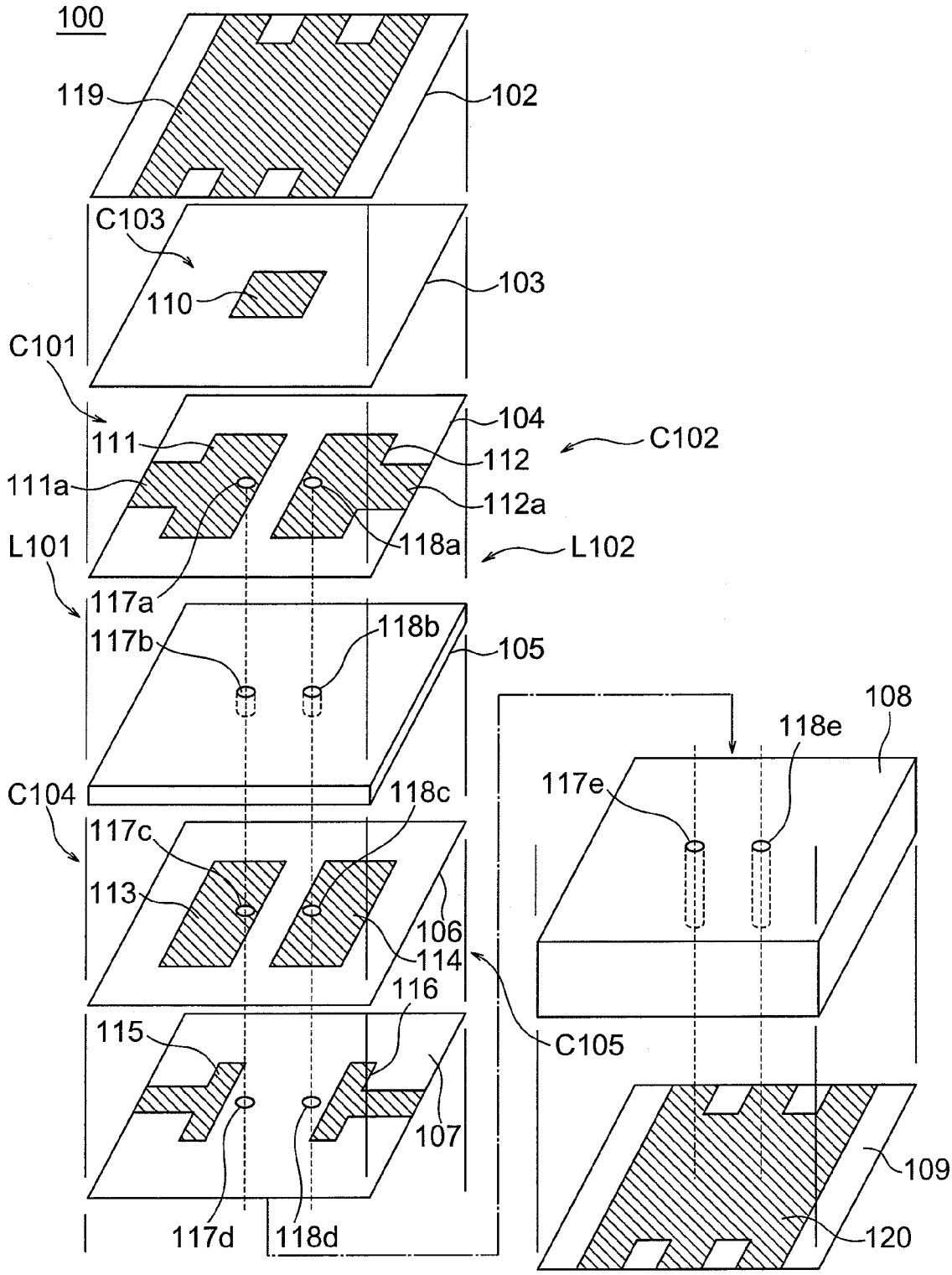
FIG. 2 PRIOR ART
FIG. 2 is an exploded schematic perspective view of a known laminate type LC filter having the electric equivalent circuit diagram of FIG. 1.

Now, the third embodiment of laminate type band pass filter having a circuit configuration as shown in FIG. 1 will be described below by referring to FIGS. 10 through 12.

Figure 10:
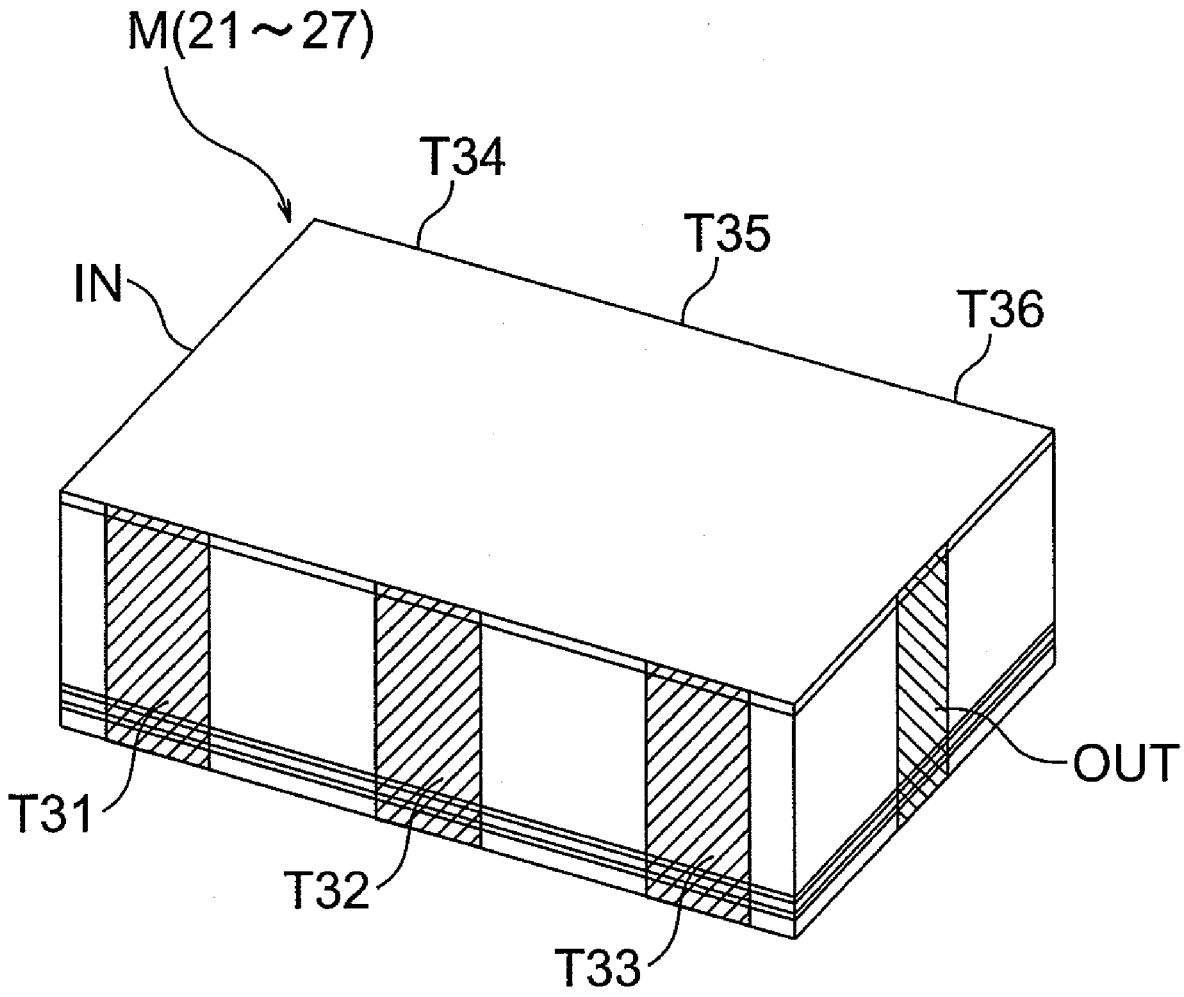
FIG. 10 is a schematic perspective view of the third embodiment of laminate type band pass filter having the circuit configuration of FIG. 3, showing the appearance thereof.

FIG. 10 is a schematic perspective view of the third embodiment of laminate type band pass filter having the circuit configuration of FIG. 3, showing the appearance thereof. FIG. 11 is schematic plan views of the dielectric layers of the third embodiment of laminate type band pass filter. FIG. 12 is an exploded schematic perspective view of the band pass filter of FIG. 10.

Figure 11:
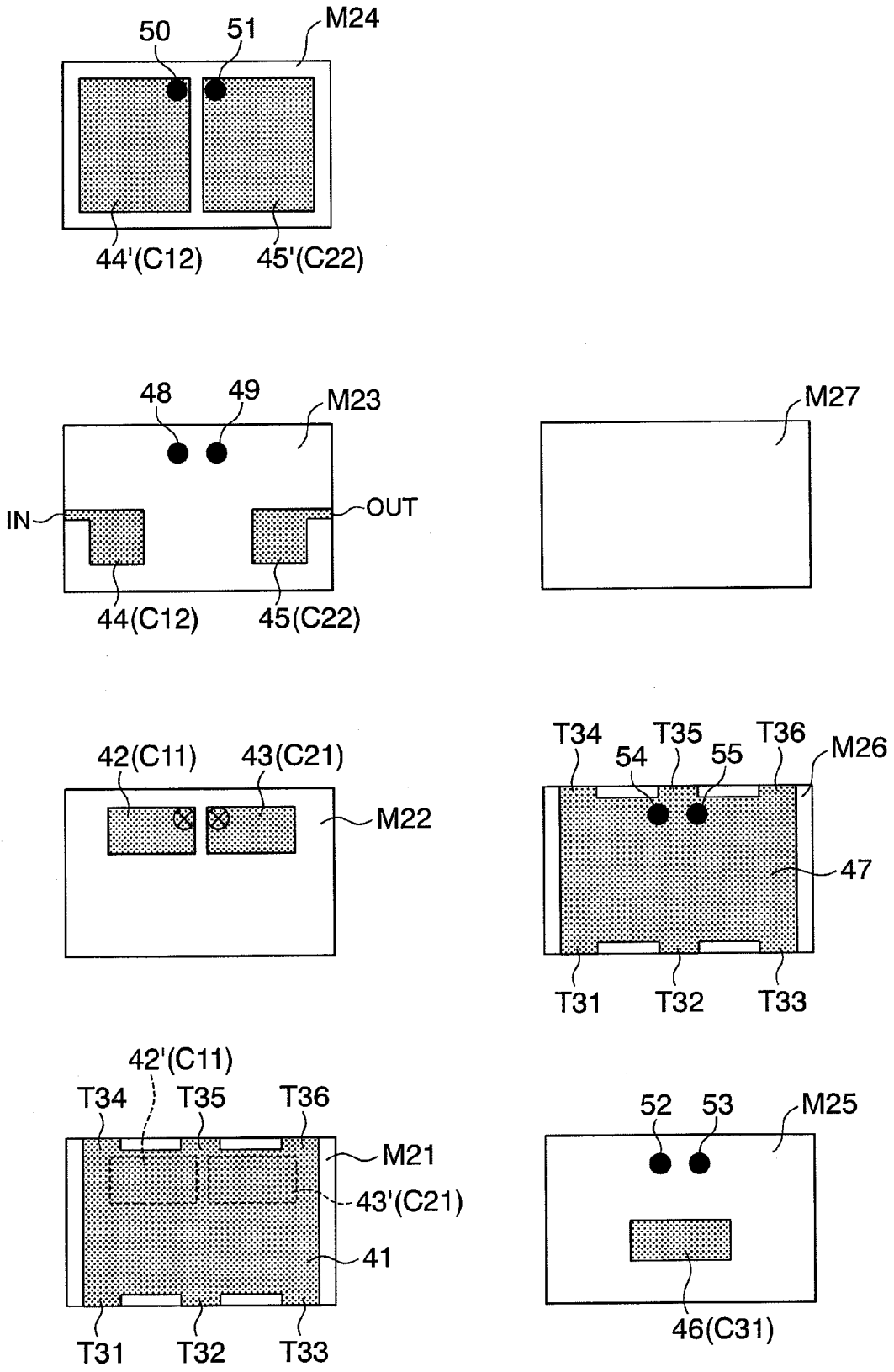
FIG. 11 is schematic plan views of the dielectric layers of the band pass filter of FIG. 10.
Figure 12:
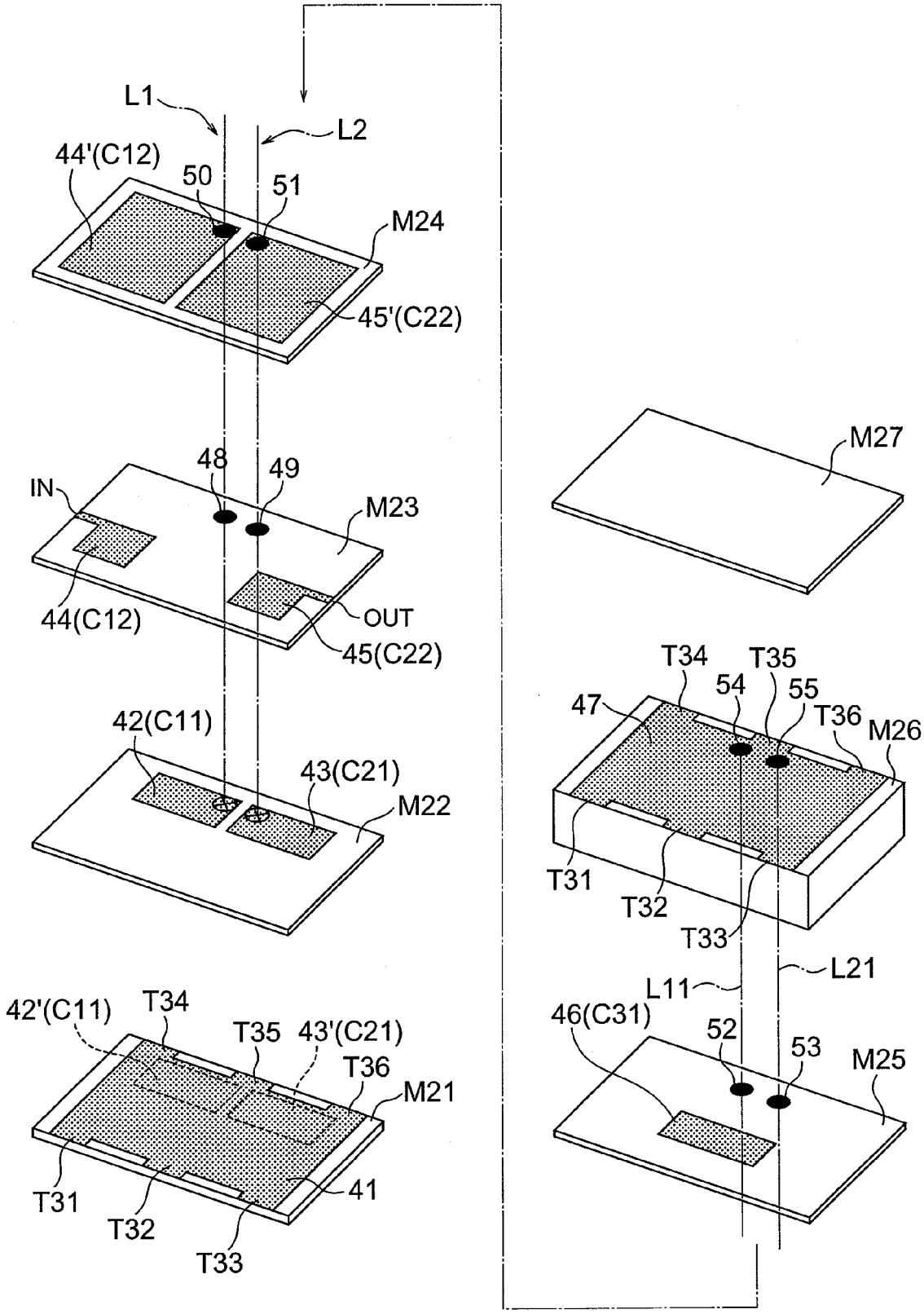
FIG. 12 is an exploded schematic perspective view of the band pass filter of FIG. 10.

As shown in FIGS. 10, 11 and 12, the laminate type band pass filter includes a total of seven dielectric layers M21 through M27.

The dielectric layers M21, M23, M26 and M27 are made of a material showing a relatively low dielectric constant (e.g., dielectric constant $\in$ 7), whereas the dielectric layers M22, M24 and M25 are made of a material showing a relatively high dielectric constant (e.g., dielectric constant $\in$ 15).

The dielectric layers M21, M22, M23, M24, M25, M26 and M27 respectively have thicknesses of 0.06 mm, 0.019 mm, 0.03 mm, 0.019 mm, 0.019 mm, 0.526 mm and 0.03 mm.

A pair of oppositely disposed major lateral sides of each of the dielectric layers M21 through M27 is provided at each of the lateral sides with three grounding terminals T31, T32, T33, T34, T35 and T36 that are formed by printing. A pair of oppositely disposed minor lateral sides of each of the dielectric layers M21 through M27, an input terminal IN and an output terminal OUT is provided respectively with an input terminal IN and an output terminal OUT that are formed by printing.

Now, the configuration of each of the dielectric layers M21 through M27 will be described in greater detail below.

A grounding electrode 41 is formed on the lowermost first dielectric layer M21 and connected to grounding terminals T31 through T36.

One of the electrodes, or electrode 42, of the capacitor C11 for forming the resonators R1 and R3 and one of the electrodes, or electrode 43, of the capacitor C21 for forming the resonators R2 and R4 are formed on the second dielectric layer M22.

The other electrode of the capacitor C11 and that of the capacitor C21 are formed respectively at parts 42' and 43' located at corresponding positions of the grounding electrode 41 of the dielectric layer M21.

One of the electrodes, or electrode 44, of the capacitor C12 and one of the electrodes, or electrode 45, of the capacitor C22 are formed on the third dielectric layer M23. The other electrodes 44' and 45' of the capacitors C12 and C22 are formed on the fourth dielectric layer M14.

The electrode 44 of the opposite electrodes of the capacitor C12 on the third dielectric layer M23 is connected to the input terminal IN. Similarly, the electrode 45 of the opposite electrodes of the capacitor C22 on the third dielectric layer M23 is connected to the output terminal OUT.

One of the electrodes, or electrode 46, of the capacitor C31 is formed on the fifth dielectric layer M25 and a grounding electrode 47 is formed on the sixth dielectric layer M26 and connected to the grounding terminals T31 through T36.

The other electrode of the capacitor C31 is formed by the other electrodes 44' and 45' of the capacitors C12 and C22 formed on the dielectric layer M24. With the above-described arrangement, the capacitors C12, C22 and C31 are connected in series.

Via conductors are formed through the dielectric layers M23, M24, M25 and M26 to produce resonance elements.

In FIGS. 11 and 12, the reference symbols 48 and 49 denote respective via conductors formed in the dielectric layer M23 and the reference symbols 50 and 51 denote respective via conductors formed in the dielectric layer M24, while reference symbols 52 and 53 denote respective via conductors formed in the dielectric layer M25 and reference symbols 54 and 55 denote respective via conductors formed in the dielectric layer M26.

The via conductor 48 formed in the dielectric layer M23 runs through the dielectric layer M23 and its lower end is connected to the electrode 42 of the opposite electrodes of the capacitor C11.

The via conductor 49 formed in the dielectric layer M23 runs through the dielectric layer M23 and its lower end is connected to the electrode 43 of the opposite electrodes of the capacitor C21.

The via conductor 50 formed in the dielectric layer M24 runs through the dielectric layer M24 and its upper end is connected to the other electrode 44' of the capacitor C12, while its lower end is connected to the via conductor 48 of the dielectric layer M23.

The via conductor 51 formed in the dielectric layer M24 runs through the dielectric layer M24 and its upper end is connected to the other electrode 45' of the capacitor C22, while its lower end is connected to the via conductor 49 of the dielectric layer M23.

The via conductor 52 formed in the dielectric layer M25 runs through the dielectric layer M25 and its lower end is connected to the via conductor 50 of the dielectric layer M24 by way of the other electrode 44' of the capacitor C12.

The via conductor 53 formed in the dielectric layer M25 runs through the dielectric layer M25 and its lower end is connected to the via conductor 51 of the dielectric layer M24 by way of the other electrode 45' of the capacitor C22.

The via conductor 54 formed in the dielectric layer M26 runs through the dielectric layer M26 and its upper end is connected to the grounding electrode 47, while its lower end is connected to the via conductor 52 of the dielectric layer M25.

The via conductor 55 formed in the dielectric layer M26 runs through the dielectric layer M26 and its upper end is connected to the grounding electrode 47, while its lower end is connected to the via conductor 53 of the dielectric layer M25.

With the above-described arrangement, the single resonance element L1 is formed by the via conductors 48, 50, 52 and 54 and the electrode 42 of the opposite electrodes of the capacitor C11, whereas the single resonance element L2 is formed by the via conductors 49, 51, 53 and 55 and the electrode 43 of the opposite electrodes of the capacitor C21.

The axial direction of the two resonance elements L1 and L2 is perpendicular to the surfaces of the dielectric layers M21 through M27 and hence, as an electric current flows through the resonance elements L1 and L2, a magnetic field that runs round on a plane perpendicular to the axial direction of the resonance elements L1 and L2 is generated around each of the elements.

One of the resonance elements, or the resonance element L1 that is formed by the via conductors 48, 50, 52 and 54 and the electrode 42 of the opposite electrodes of the capacitor C11, has a structure where an intermediate tap is formed between the part of the resonance element L12 formed by the via conductors 48 and 50 and the part of the resonance element L11 formed by the via conductors 52 and 54 due to the electrodes 44, 44' and 46 of the capacitors C12 and C31.

On the other hand, the other resonance element L2 formed by the via conductors 49, 51, 53 and 55 and the electrode 43 of the opposite electrodes of the capacitor C21 has a structure where an intermediate tap is formed between the part of the resonance element L22 formed by the via conductors 49 and 51 and the part of the resonance element L21 formed by the via conductors 53 and 55 due to the electrodes 45, 45' and 46 of the capacitors C22 and C31.

With the above-described arrangement of the laminate type band pass filter, the resonance frequency of the first and second resonators R1 and R2 can be adjusted by modifying the sizes of the inductors formed by the via holes 48 through 55 bored through the dielectric layers M23, M24, M25 and M26. More specifically, the sizes of the inductors can be adjusted by modifying the thickness of the laminate type band pass filter. The resonance frequency can be adjusted by modifying the electrostatic capacitances of the capacitors C11 and C21. More specifically, the electrostatic capacitances of the capacitors C11 and C21 can be adjusted by modifying the sizes of the electrodes 42 and 43 of the dielectric layer M22 or by modifying the thickness of the dielectric layer M22.

On the other hand, each of the elements of the second resonators R3 and R4 is defined so as to resonate at the high frequency side of the resonance frequency of the first resonators R1 and R2 and the resonance frequency can be adjusted by modifying the electrostatic capacitances of the capacitors C11 and C21. More specifically, the electrostatic capacitances of the capacitors C11 and C21 can be adjusted by modifying the sizes of the electrodes 42 and 43 of the dielectric layer M22 or by modifying the thickness of the dielectric layer M22. Additionally, they can also be adjusted by modifying the sizes of the inductors formed by the via holes 48 through 51 bored through the dielectric layers M23 and M24. More specifically, the sizes of the inductors can be adjusted by modifying the thicknesses of the dielectric layers M23 and M24.

Figure 13:
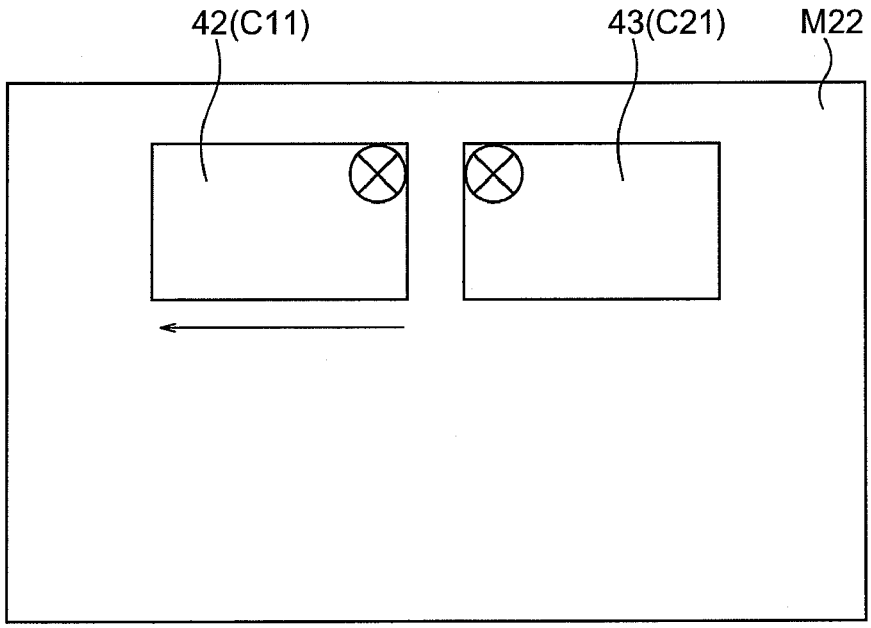
FIG. 13 is a graph showing the resonance frequencies that can be obtained when the size of the electrode 42 and that of the electrode 43 of the dielectric layer M22 are modified in the laminate type band pass filter illustrated in FIGS. 10 through 12.
Figure 13:
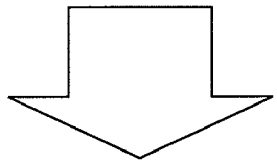
Figure 13:
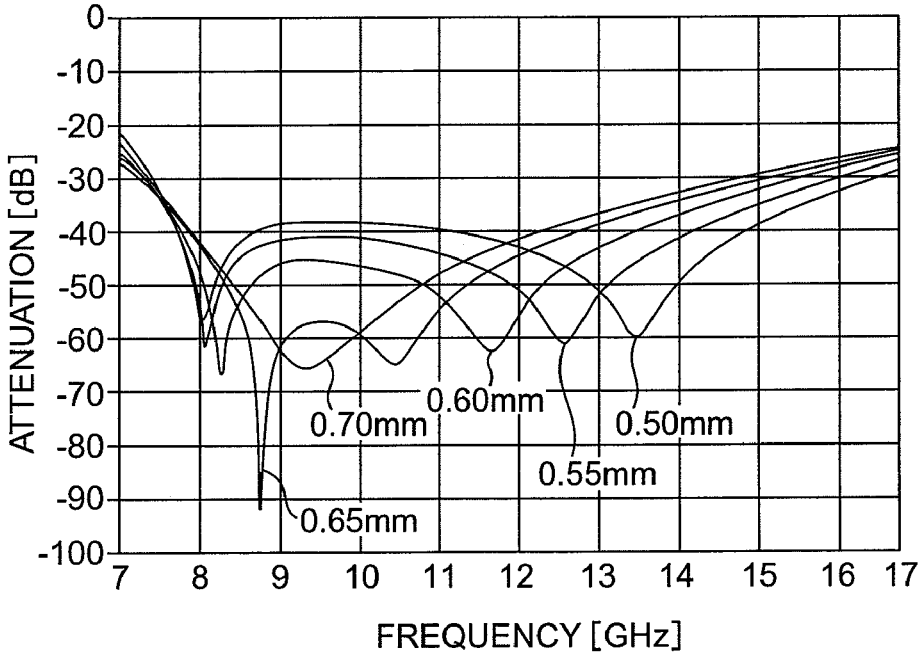

FIG. 13 is a graph showing the frequency characteristics of the laminate type band pass filter that can be obtained when the size of the electrode 42 and that of the electrode 43 are modified from 0.5 mm to 0.7 mm at a step of 0.05 mm in the direction of the arrow in FIG. 13.

From FIG. 13, it will be seen that the resonance frequency of the second resonators R3 and R4 is shifted toward the high frequency side as the sizes of the electrodes 42 and 43 are reduced.

The above-described embodiments are so many laminate type band pass filters having a single pass band. The present invention can also provide a diplexer that shows excellent attenuation characteristics at the high frequency side and is formed by using a band pass filter having a first pass band and a band pass filter having a second pass band when either or both of them are band pass filters according to the present invention.

For example, in a diplexer according to the present invention, both the band pass filter having a first pass band and the band pass filter having a second pass band may be of the distributed constant type as described above by way of the embodiments.

In a diplexer according to the present invention, the band pass filter having a first pass band may be of the distributed constant type and the band pass filter having a second pass band may be of the lumped constant type.

What is claimed is:

1. A laminate type band pass filter comprising a plurality of first resonators adapted to resonate in a predetermined pass band and arranged in a laminate body, the first resonators being mutually electromagnetic field coupled, wherein each of the first resonators includes a first inductor conductor, a second inductor conductor and a conductor to be capacitive-coupled to a grounding conductor, each of the first resonators includes a second resonator therein, each of the second resonators including the second inductor conductor and the conductor to be capacitive-coupled to the grounding conductor, and each of the second resonators has a notch frequency set in a frequency band higher than a resonance frequency band of the first resonators.

2. The laminate type band pass filter according to claim 1, wherein the laminate body comprises a plurality of dielectric layers having various thicknesses.

3. The laminate type band pass filter according to claim 2, wherein said each first resonator includes a capacitor that is connected to the grounding conductor formed on one of the dielectric layers.

4. The laminate type band pass filter according to claim 2, wherein the first and second inductor conductors comprise via conductors provided in the selected ones of the dielectric layers.

5. The laminate type band pass filter according to claim 1, wherein the second inductor conductor and a capacitor in the second resonators are defined so as to resonate at the high frequency side of the resonance frequency of the first resonators.

6. The laminate type band pass filter according to claim 1, wherein the resonance frequency of the first resonators is adjusted by modifying sizes of the first and second inductor conductors.

7. The laminate type band pass filter according to claim 6, wherein the resonance frequency of the first resonators is adjusted by modifying a thickness of the dielectric layers in which the first and second inductor conductors are formed.

8. The laminate type band pass filter according to claim 1, wherein the resonance frequency of the second resonators is adjusted by modifying electrostatic capacitances of a capacitor.

9. The laminate type band pass filter according to claim 1, wherein the resonance frequency of the second resonators is adjusted by modifying sizes of the first and second inductor conductors.

10. The diplexer comprising a first filter having a first pass band and a second filter having a second pass band, wherein either or both of the two filters is a band pass filter or band pass filters according to claim 1.

* * * * *